US012152447B2

(12) United States Patent
Trosper

(10) Patent No.: US 12,152,447 B2
(45) Date of Patent: Nov. 26, 2024

(54) BLOWOUT PREVENTER ASSEMBLY

(71) Applicant: Mike Trosper, Bellaire, MI (US)

(72) Inventor: Mike Trosper, Bellaire, MI (US)

( * ) Notice: Subject to any disclaimer, the term of this patent is extended or adjusted under 35 U.S.C. 154(b) by 225 days.

(21) Appl. No.: 17/965,546

(22) Filed: Oct. 13, 2022

(65) Prior Publication Data

US 2024/0125187 A1 Apr. 18, 2024

(51) Int. Cl.
*E21B 19/16* (2006.01)
*E21B 21/10* (2006.01)

(52) U.S. Cl.
CPC ..... *E21B 19/16* (2013.01); *E21B 21/106* (2013.01)

(58) Field of Classification Search
CPC ..... E21B 19/16; E21B 21/106
See application file for complete search history.

(56) References Cited

U.S. PATENT DOCUMENTS 1,552,062 A * 9/1925 Krell ..... E21B 19/10 414/626
1,635,749 A 7/1927 Hosmer
1,812,351 A * 6/1931 Marsh ..... E21B 19/14 414/22.63
1,884,874 A * 10/1932 Ross ..... E21B 19/167 81/57.24
2,690,847 A * 10/1954 Crookston ..... E21B 19/14 175/85
2,692,059 A * 10/1954 Bolling, Jr. ..... E21B 19/14 29/272
2,829,783 A * 4/1958 Blagg ..... E21B 19/14 294/104
3,533,516 A * 10/1970 Guier ..... E21B 19/14 414/745.2
4,172,684 A * 10/1979 Jenkins ..... E21B 19/14 901/14
4,274,777 A * 6/1981 Scaggs ..... E21B 19/20 294/201
4,291,762 A 9/1981 Gudgel
4,442,892 A 4/1984 Delesandri
4,582,133 A * 4/1986 Tambs ..... E21B 19/20 166/77.51
4,621,974 A * 11/1986 Krueger ..... E21B 19/20 414/800
4,686,873 A * 8/1987 Lang ..... E21B 19/16 81/57.35

(Continued)

FOREIGN PATENT DOCUMENTS

CA 3063558 6/2020

*Primary Examiner* — Aaron L Lembo

(57) ABSTRACT

A blowout preventer assembly for installing a safety valve in a drill pipe includes a jack mounted to a drilling platform in an oil field. The device includes an extension arm attached to the jack which has a first portion slidably engaging a second portion such that the extension arm has an adjustable length. An actuator is attached to the extension arm to urge the second portion to travel toward or away from the jack thereby facilitating the collar to is positioned over a drill pipe which is integrated into the drilling platform. A slip die is insertable into a collar on the extension arm thereby facilitating the slip die to engage a drill pipe sub joint which has a safety valve. The collar aligns the safety valve with the drill pipe thereby facilitating the safety valve to be lowered into the drill pipe when the jack is actuated into the lowering condition.

12 Claims, 5 Drawing Sheets

(56) References Cited

U.S. PATENT DOCUMENTS 5,351,767 A * 10/1994 Stogner ..... E21B 19/16 175/203
5,390,568 A * 2/1995 Pietras ..... E21B 19/16 81/57.24
5,609,457 A * 3/1997 Burns ..... E21B 19/24 175/85
6,158,516 A * 12/2000 Smith ..... E21B 19/22 175/89
6,189,620 B1 * 2/2001 McDowell ..... E21B 21/106 166/85.4
6,318,214 B1 * 11/2001 Buck ..... E21B 19/165 81/57.35
6,488,094 B1 * 12/2002 McDowell ..... E21B 21/106 166/85.4
6,681,894 B1 * 1/2004 Fanguy ..... E04G 1/36 182/128
7,040,411 B2 5/2006 Kainer
7,083,363 B2 * 8/2006 Baker ..... E02D 35/00 52/169.9
7,117,948 B2 10/2006 Mazzella
7,246,546 B1 * 7/2007 Knoblock ..... B25B 13/488 81/184
7,341,109 B1 * 3/2008 McDowell ..... E21B 19/16 166/78.1
7,509,722 B2 * 3/2009 Shahin ..... E21B 19/20 166/85.1
7,527,100 B2 * 5/2009 Abadie ..... E21B 29/005 166/298
7,690,281 B2 * 4/2010 Hobgood ..... E21B 19/165 81/57.35
7,802,636 B2 * 9/2010 Childers ..... E21B 19/20 175/203
7,896,178 B2 * 3/2011 Davis ..... B66C 23/365 212/196
9,027,217 B2 * 5/2015 Cranford ..... E21B 19/00 166/85.4
9,382,768 B2 * 7/2016 Garber ..... E21B 19/166
9,637,984 B2 * 5/2017 Webre ..... E21B 19/10
9,915,110 B2 * 3/2018 Berrier ..... E21B 19/164
2017/0211340 A1 * 7/2017 Alford ..... E21B 33/068
2020/0256136 A1 8/2020 Miller

* cited by examiner

BLOWOUT PREVENTER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to blowout devices and more particularly pertains to a new blowout device for installing a safety valve in a drill pipe. The device includes a jack mounted to a drilling platform and an extension arm transversely oriented with the jack. The extension arm has an adjustable length and an actuator is attached to the extension arm for extending or retracting the extension arm. A collar is attached to the extension arm for insertably receiving a slip die which engages a drill pipe sub joint to which is attached a safety valve. The extension arm is aligned with the drill pipe and the jack is lowered to install the safety valve into the drill pipe. The prior art discloses a blowout preventer that includes a tilting frame and a telescopic actuator for tipping a safety valve into a drill pipe.

(2) Description of Related Art Including Information Disclosed Under 37 CFR 1.97 and 1.98

The prior art relates to blowout devices including a blowout preventer that includes a pulley and cable for lowering a safety valve into a drill pipe. The prior art discloses a blowout preventer device that includes a frame positionable around a drill pipe which includes a pair of vertically oriented telescopic members for lowering a safety valve into the drill pipe. The prior art discloses a blowout preventer that includes a series of gears and a hand crank for lowering a safety valve into a drill pipe. The prior art discloses a blowout preventer that includes a plurality of hydraulic actuators that are vertically arranged around a drill pipe for lowering a safety valve into a drill pipe.

BRIEF SUMMARY OF THE INVENTION

An embodiment of the disclosure meets the needs presented above by generally comprising a jack mounted to a drilling platform in an oil field. The device includes an extension arm attached to the jack which has a first portion slidably engaging a second portion such that the extension arm has an adjustable length. An actuator is attached to the extension arm to urge the second portion to travel toward or away from the jack thereby facilitating the collar to is positioned over a drill pipe which is integrated into the drilling platform. A slip die is insertable into a collar on the extension arm thereby facilitating the slip die to engage a drill pipe sub joint which has a safety valve. The collar aligns the safety valve with the drill pipe thereby facilitating the safety valve to be lowered into the drill pipe when the jack is actuated into the lowering condition.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
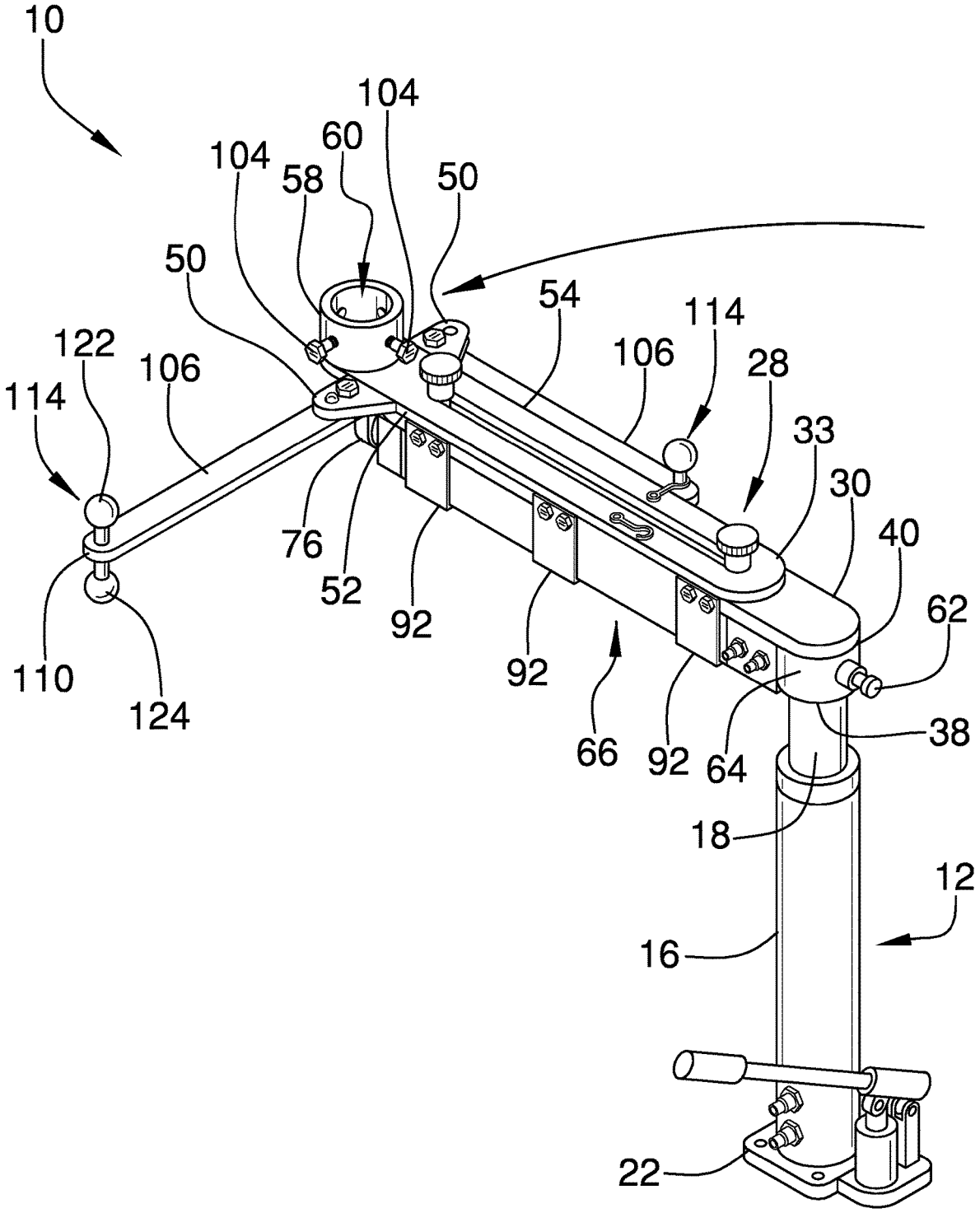
FIG. 1 is a top perspective view of a blowout preventer assembly according to an embodiment of the disclosure.
Figure 2:
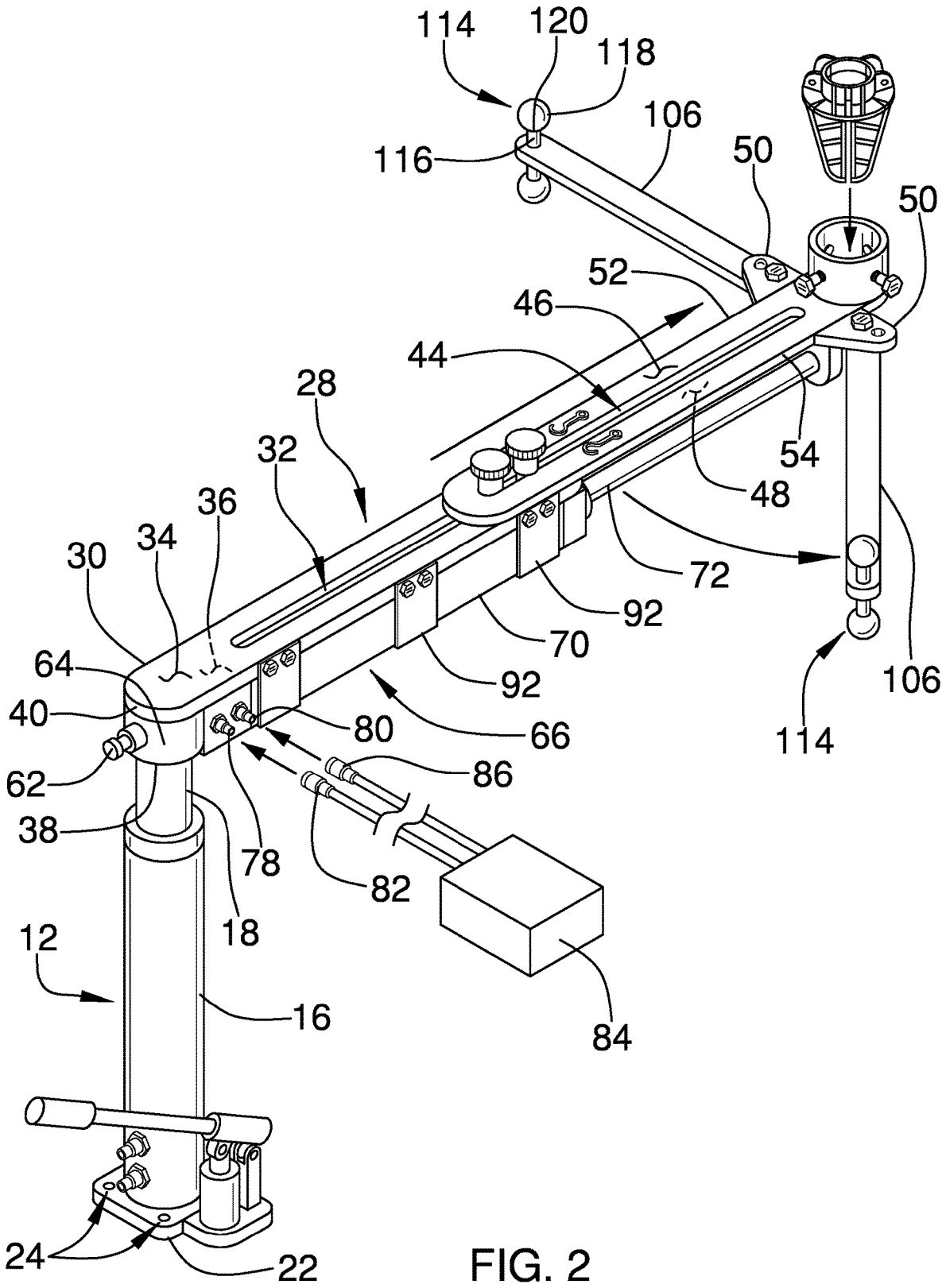
FIG. 2 is a perspective view of an embodiment of the disclosure showing a slip die being inserted into a collar.
Figure 3:
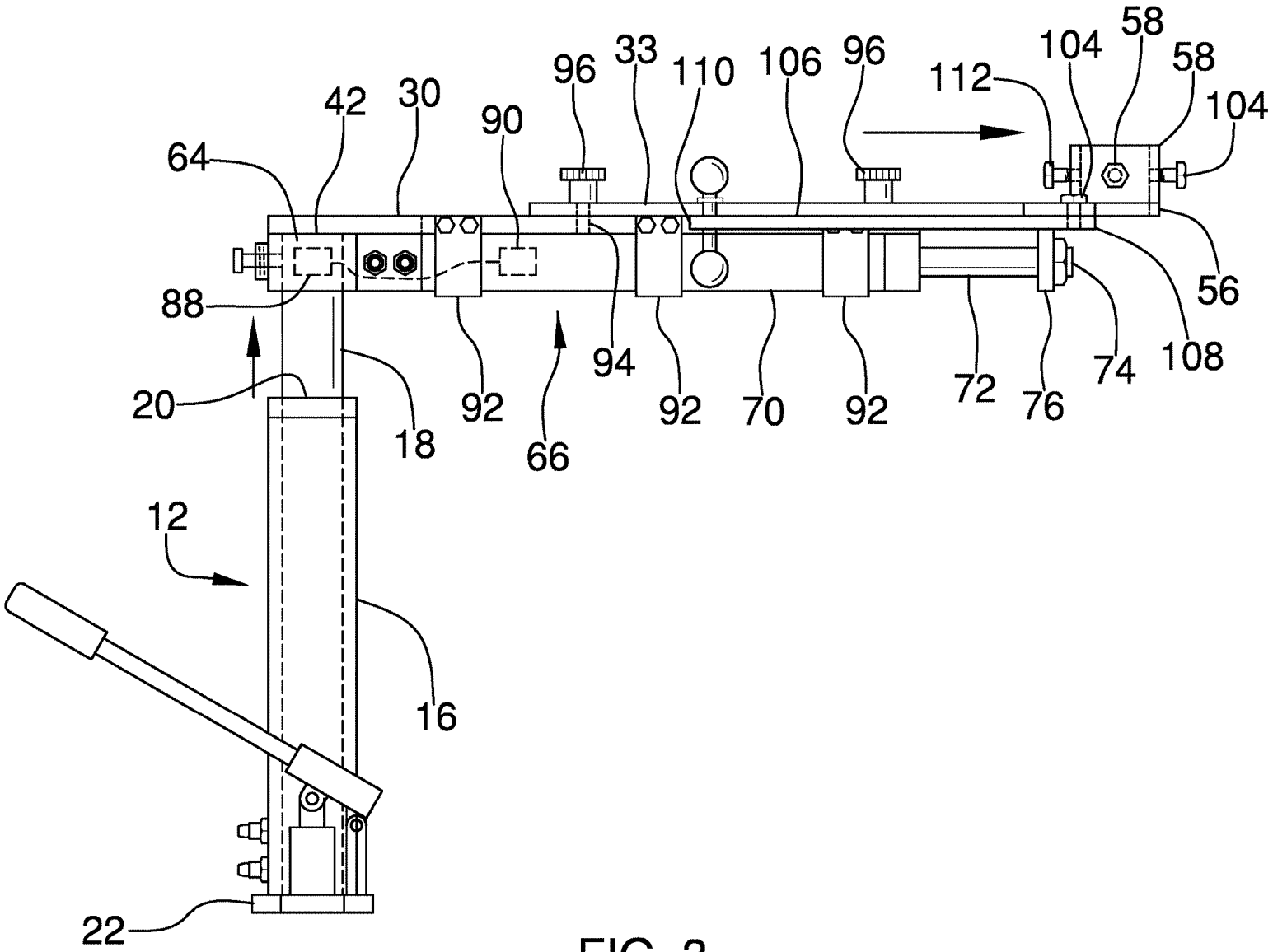
FIG. 3 is a right side view of an embodiment of the disclosure.
Figure 4:
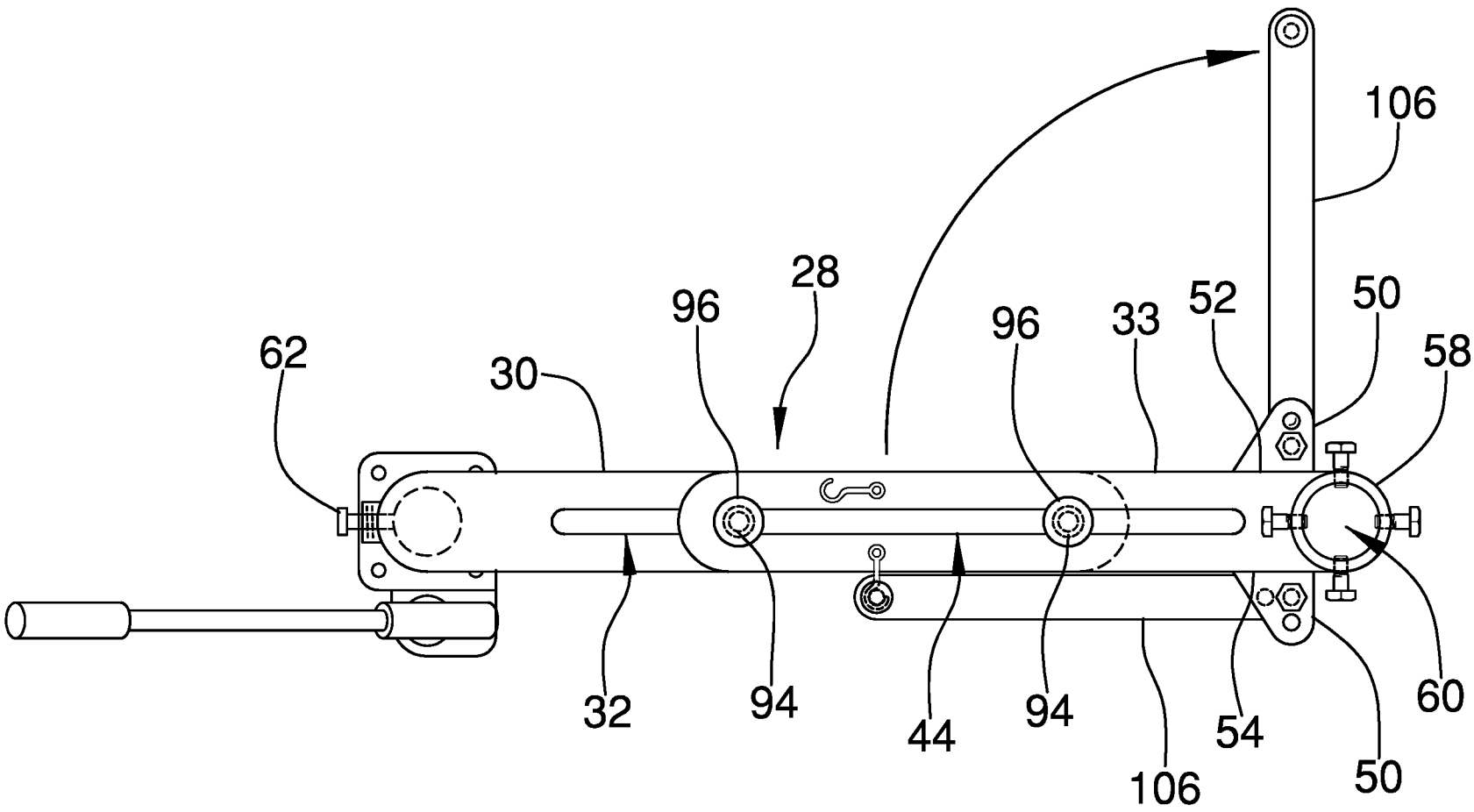
FIG. 4 is a top view of an embodiment of the disclosure.
Figure 5:
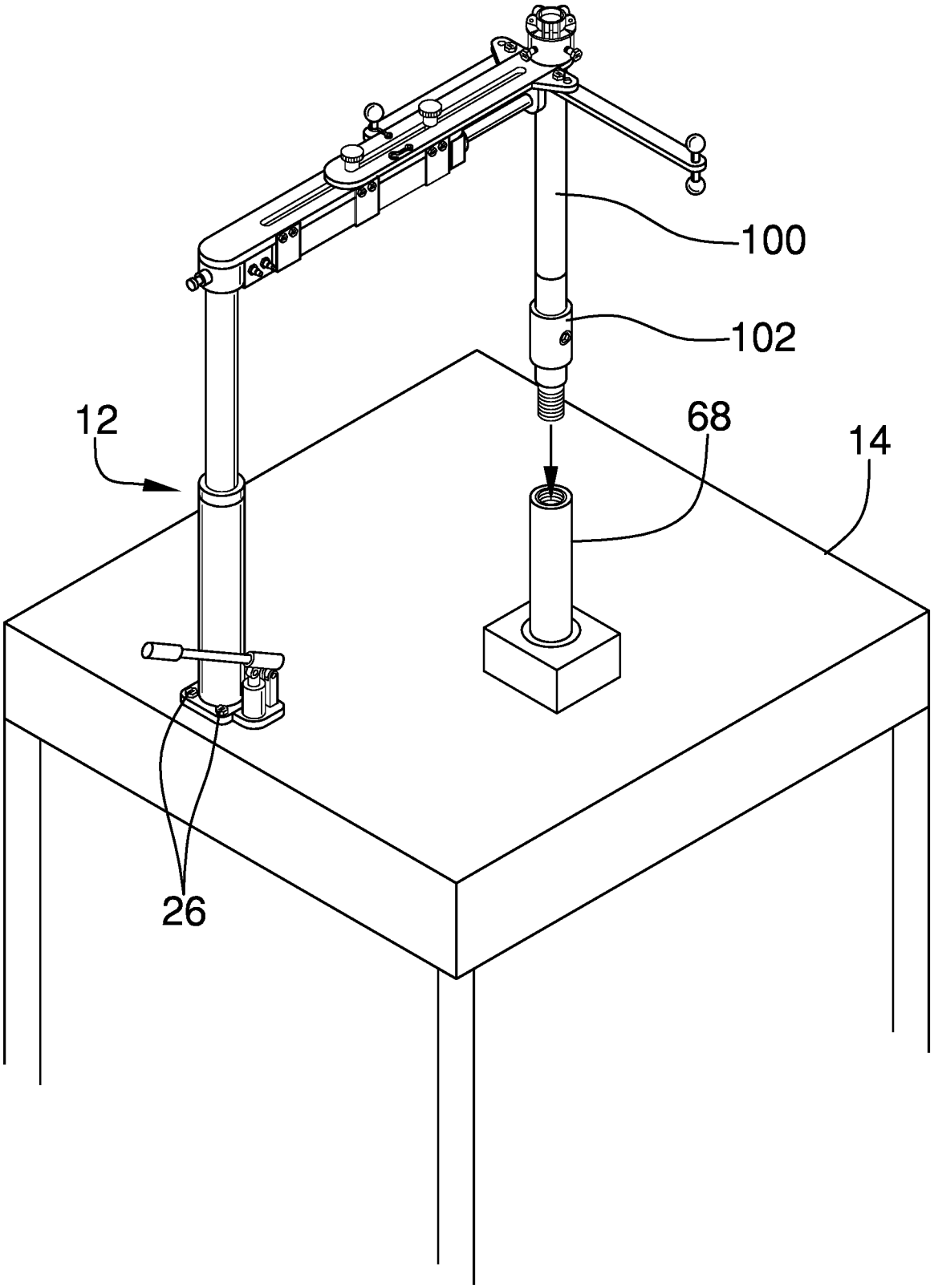
FIG. 5 is a perspective in-use view of an embodiment of the disclosure.

With reference now to the drawings, and in particular to FIGS. 1 through 5 thereof, a new blowout device embodying the principles and concepts of an embodiment of the disclosure and generally designated by the reference numeral 10 will be described.

As best illustrated in FIGS. 1 through 5, a jack 12 is provided which is mountable to a drilling platform 14 in an oil field. The drilling platform 14 may be an integral component of an oil drilling rig that would commonly be employed in oil field drilling involved in the construction of oil wells, natural gas wells and other types of underground drilling for capturing naturally occurring energy sources. The jack 12 is actuatable into a lifting condition or a lowering condition and the jack 12 comprises a cylinder 16 and a piston 18 that is slidably disposed in the cylinder 16. The piston 18 is urged upwardly from an upper end 20 of the cylinder 16 when the jack 12 is actuated into the lifting condition and the piston 18 is urged downwardly into the upper end 20 of the cylinder 16 when the jack 12 is actuated into the lowering condition.

A base 22 of the cylinder 16 is attachable to the drilling platform 14 such that the cylinder 16 and the piston 18 are vertically oriented on the drilling platform 14. The base 22 has a plurality of fastener holes 24 for receiving fasteners 26 which engages the drilling platform 14 for retaining the cylinder 16 on the drilling platform 14. The jack 12 may comprise a hydraulic jack and the jack 12 might be mechanically coupled to a power take off of the drilling rig, the jack 12 might be manually operated with a lever attached to pump or the jack 12 might be electrically controlled.

An extension arm 28 is attached to the jack 12 such that the extension arm 28 is lifted or lowered with respect to the drilling platform 14 when the jack 12 is actuated into a respective lifting condition or lowering condition. The extension arm 28 is oriented to extend laterally away from the jack 12 and the extension arm 28 has a first portion 30 that slidably engages a second portion 33 such that the extension arm 28 has an adjustable length. The first portion 30 has a first slot 32 which extends through a top surface 34 and a bottom surface 36 of the first portion 30 and the first slot 32 is elongated to extend along a substantial length of the first portion 30. The first portion 30 includes a cup 38 extending downwardly from the bottom surface 36, the cup 38 is aligned with a coupled end 40 of the first portion 30 and the cup 38 insertably receives a top end 42 of the piston 18 of the jack 12.

The second portion 33 has a second slot 44 extending through an upper surface 46 and a lower surface 48 of the second portion 33. The lower surface 48 rests on the top surface 34 of the first portion 30 such that the second slot 44 is aligned with the first slot 32. The second portion 33 has a pair of wings 50 each extending laterally away from a respective one of a first lateral edge 52 and a second lateral edge 54 of the second portion 33 and each of the wings 50 is aligned with a free end 56 of the second portion 33. The extension arm 28 has a collar 58 that is integrated into the second portion 33 and the collar 58 is positioned adjacent to the free end 56 of the second portion 33 such that an opening 60 defined by the collar 58 is oriented to extend along an axis that is perpendicularly oriented with the extension arm 28. The collar 58 may have a diameter of at least 10.0 cm thereby facilitating the collar 58 to accommodate drill pipe 68 heads that are commonly employed in the oil drilling industry.

A lock 62 is movably integrated into an outer wall 64 of the cup 38 on the first portion 30 of the extension arm 28. The lock 62 is biased into an engaging position such that the lock 62 engages the piston 18 of the jack 12 for retaining the cup 38 at a desired degree of rotation on the actuator piston 72. Conversely, the lock 62 is urgeable into a releasing position such that the lock 62 disengages the piston 18 thereby facilitating the cup 38 to be rotated on the piston 18.

An actuator 66 is attached to the first portion 30 of the extension arm 28 and the actuator 66 engages the second portion 33 of the extension arm 28. The actuator 66 is actuatable in an extended condition thereby urging the second portion 33 to travel away from the jack 12 thereby facilitating the collar 58 to be positioned over a drill pipe 68 which is integrated into the drilling platform 14. In this way the actuator 66 can align the collar 58 with the drill pipe 68 without requiring a worker to align the collar 58 with the drill pipe 68 thereby inhibiting the worker from being exposed to explosive gasses that might be exiting the drill pipe 68. Additionally, the actuator 66 is actuatable in a retracting condition thereby urging the second portion 33 to travel toward the jack 12.

The actuator 66 has an actuator cylinder 70 that is attached to the bottom surface 36 of the first portion 30 of the extension arm 28 and the actuator 66 has an actuator piston 72 that is slidably integrated into the actuator cylinder 70. The actuator piston 72 extends outwardly from the actuator cylinder 70 when the actuator 66 is actuated into the extended condition and the actuator piston 72 retracts into the actuator cylinder 70 when the actuator piston 72 actuated into the retracting condition. The actuator piston 72 has a distal end 74 with respect to the actuator cylinder 70 and the distal end 74 is attached to an engagement 76 which is disposed on the lower surface 48 of the second portion 33 of the extension arm 28. The actuator 66 may comprise a hydraulic actuator or a pneumatic actuator.

The actuator cylinder 70 has an input port 78 that is in fluid communication with an interior of the actuator cylinder 70 and the actuator cylinder 70 has an output port 80 that is in fluid communication with the interior of the actuator cylinder 70. The input port 78 is fluidly attachable to a send line 82 of a fluid source 84 thereby facilitating a fluid to be pumped into the actuator cylinder 70 thereby urging the actuator piston 72 to extend outwardly from the actuator cylinder 70. Additionally, the output port 80 is fluidly attachable to a return line 86 of the fluid source 84 thereby facilitating the fluid to exit the actuator cylinder 70 thereby urging the actuator piston 72 to retract into the actuator cylinder 70. The fluid source 84 may be a hydraulic oil pump or a pneumatic air pump. As is most clearly shown in FIG. 3, an electric motor 88 might be integrated into the cup 38 for rotating the cup 38 on the actuator piston 72 and the electric motor 88 might be in electrical communication with a radio frequency receiver 90 to facilitate the extension arm 28 to be remotely controlled. Furthermore, each of the jack 12 and the actuator 66 might be electrically coupled to the radio frequency receiver 90 for remotely controlling the jack 12 and the actuator 66.

A plurality of brackets 92 is each attached to the first portion 30 of the extension arm 28. Each of the brackets 92 engages the actuator cylinder 70 of the actuator 66 for attaching the actuator cylinder 70 to the first portion 30. A pair of pins 94 is provided and each of the pins 94 extends through the second slot 44 in the second portion 33 of the extension arm 28. Each of the pins 94 extends through the first slot 32 in the first portion of the extension arm 28 such that the second portion 33 is slidably retained on the first portion 30. Each of the pins 94 includes knob 96 which abuts the upper surface 46 of the second portion 33. Additionally, the knob 96 has a diameter that is greater than a width of the second slot 44 thereby inhibiting the second portion 33 from being removed from the pins 94.

A slip die 98 is insertable into the collar 58 thereby facilitating the slip die 98 to engage a drill pipe sub joint 100 and a safety valve 102 that is attached to the drill pipe sub joint 100. The collar 58 aligns the safety valve 102 with the drill pipe 68 thereby facilitating the safety valve 102 to be lowered into the drill pipe 68 when the jack 12 is actuated into the lowering condition. In this way the collar 58 facilitates the safety valve 102 to be safely inserted into the drill pipe 68 without requiring the worker to manually insert the safety valve 102. The slip die 98 may be a slip die of any conventional design that is commonly employed in oil drilling rigs to grip and hold a drill pipe. Furthermore, the diameter of the collar 58 facilitates slip dies of various sizes to be inserted into the collar 58 for accommodating any size drill pipes and slip dies that might be encountered in an oil field. The safety valve 102 may comprise a Full Opening Safety valve (TIW Valve) of any conventional design that is commonly employed in oil drilling operations. A pair of screws 104 is each threaded into an outer wall 106 of the collar 58. Each of the screws 104 engages the slip die 98 when the screws 104 are tightened for retaining the slip die 98 in the collar 58. Conversely, each of the screws 104 disengages the slip die 98 when the screws 104 are loosened thereby facilitating the slip die 98 to be removed from the collar 58.

A pair of swing arms 106 is each pivotally attached to the extension arm 28. Each of the swing arms 106 is positionable in a stored position having the swing arms 106 being positioned against the extension arm 28. Conversely, each of the swing arms 106 is positionable in a deployed position having the swing arms 106 extending laterally away from the extension arm 28. In this way a respective one of the swing arms 106 can be gripped by the worker for manually pivoting the extension arm 28 into position for lowering the safety valve 102 into the drill pipe 68. Each of the swing arms 106 has a first end 108 and a second end 110 and each of the swing arms 106 has a pivot point 112 that is located adjacent to the first end 108. The pivot point 112 on each of the swing arms 106 is pivotally attached to a respective one of the wings 50.

A plurality of grips 114 is provided and each of the grips 114 is attached to a respective one of the swing arms 106 thereby facilitating each of the grips 114 to be gripped for manipulating the respective swing arm 106. Each of the grips 114 is positioned adjacent to the second end 110 of the respective swing arm 106. Additionally, each of the grips 114 comprises a stem 116 extending away from the respective swing arm 106 and a ball 118 disposed on a distal end 120 of the stem 116. The plurality of grips 114 includes a set of first grips 122 and a set of second grips 124. Each of the first grips 122 is disposed on a top surface 126 of the respective swing arm 106 and each of the second grips 124 is disposed on a bottom surface 128 of the respective swing arm 106.

In use, the jack 12 is actuated to elevate the extension arm 28 to a height that is sufficient to accommodate the length of the drill pipe sub joint 100 and the safety valve 102. The slip die 98 is secured in the collar 58 and the drill pipe sub joint 100 is engaged to the slip die 98. The extension arm 28 is rotated on the actuator piston 72 of the jack 12 and the actuator 66 is actuated in either the extended condition or the retracted condition, depending on which is required to position the safety valve 102 over the drill pipe 68 in the drilling platform 14. The jack 12 is actuated into the lowering condition to facilitate the safety valve 102 to be inserted into the drill pipe 68. In this way the safety valve 102 can be inserted into the drill pipe 68 without requiring a worker to manually position the safety valve 102 into the drill pipe 68. Thus, the safety valve 102 can be installed without exposing oil field workers to potential injury or death as is the common occurrence associated with installing safety valves into drill pipes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A blowout prevention installation assembly for remotely installing a safety valve into an oil field drill pipe, said assembly comprising:

a jack being mountable to a drilling platform in an oil field, said jack being actuatable into a lifting condition or a lowering condition;

an extension arm being attached to said jack such that said extension arm is lifted or lowered with respect to the drilling platform when said jack is actuated into a respective lifting condition or lowering condition, said extension arm being oriented to extend laterally away from said jack, said extension arm having a first portion slidably engaging a second portion such that said extension arm has an adjustable length, said extension arm having a collar being integrated into said second portion;

an actuator being attached to said first portion of said extension arm, said actuator engaging said second portion of said extension arm, said actuator being actuatable in an extended condition thereby urging said second portion to travel away from said jack thereby facilitating said collar to being positioned over a drill pipe which is integrated into the drilling platform wherein said actuator is configured to align said collar with the drill pipe without requiring a worker to align said collar with the drill pipe thereby inhibiting the worker from being exposed to explosive gasses exiting the drill pipe, said actuator being actuatable in a retracting condition thereby urging said second portion to travel toward said jack;

a slip die being insertable into said collar thereby facilitating said slip die to engage a drill pipe sub joint having a safety valve being attached to the drill pipe sub joint, said collar aligning the safety valve with the drill pipe thereby facilitating the safety valve to be lowered into the drill pipe when said jack is actuated into said lowering condition wherein said collar is configured to insert the safety valve into the drill pipe without requiring the worker to manually insert the safety valve;

a pair of swing arms, each of said swing arms being pivotally attached to said extension arm, each of said swing arms being positionable in a stored position having said swing arms being positioned against said extension arm, each of said swing arms being positionable in a deployed position having said swing arms extending laterally away from said extension arm wherein a respective one of said swing arms is configured to be gripped by the worker for manually pivoting said extension arm into position for lowering the safety valve into the drill pipe;

a plurality of grips, each of said grips being attached to a respective one of said swing arms thereby facilitating each of said grips to be gripped for manipulating said respective swing arm;

wherein said jack comprises a cylinder and a piston being slidably disposed in said cylinder, said piston being urged upwardly from an upper end of said cylinder when said jack is actuated into said lifting condition, said piston being urged downwardly into said upper end of said cylinder when said jack is actuated into said lowering condition, a base of said cylinder being attachable to the drilling platform such that said cylinder and said piston are vertically oriented on the drilling platform, said base having a plurality of fastener holes for receiving a fastener which engages the drilling platform for retaining said cylinder on the drilling platform;

wherein said first portion of said extension arm has a first slot extending through a top surface and a bottom surface of said first portion, said first slot being elongated to extend along a substantial length of said first portion;

wherein said first portion includes a cup extending downwardly from said bottom surface, said cup being aligned with a coupled end of said first portion, said cup insertably receiving a top end of said piston of said jack; and wherein said second portion of said extension arm has a second slot extending through an upper surface and a lower surface of said second portion, said lower surface resting on said top surface of said first portion such that said second slot is aligned with said first slot.

2. The assembly according to claim 1, wherein said second portion has a pair of wings each extending laterally away from a respective one of a first lateral edge and a second lateral edge of said second portion, each of said wings being aligned with a free end of said second portion.

3. The assembly according to claim 1, wherein said collar being positioned adjacent to said free end of said second portion such that an opening defined by said collar is oriented to extend along an axis being perpendicularly oriented with said extension arm.

4. The assembly according to claim 1, wherein said actuator has an actuator cylinder being attached to said bottom surface of said first portion of said extension arm, said actuator having an actuator piston being slidably integrated into said actuator cylinder, said actuator piston extending outwardly from said actuator cylinder when said actuator is actuated into said extended condition, said actuator piston retracting into said actuator cylinder when said actuator piston is actuated into said retracting condition, said actuator piston having a distal end with respect to said actuator cylinder, said distal end being attached to an engagement being disposed on said lower surface of said second portion of said extension arm.

5. The assembly according to claim 4, wherein said actuator cylinder has an input port being in fluid communication with an interior of said actuator cylinder, said actuator cylinder having an output port being in fluid communication with said interior of said actuator cylinder, said input port being fluidly attachable to a send line of a fluid source thereby facilitating a fluid to be pumped into said actuator cylinder thereby urging said actuator piston to extend outwardly from said actuator cylinder, said output port being fluidly attachable to a return line of the fluid source thereby facilitating the fluid to exit said actuator cylinder thereby urging said actuator piston to retract into said actuator cylinder.

6. The assembly according to claim 4, further comprising a plurality of brackets, each of said brackets being attached to said first portion of said extension arm, each of said brackets engaging said actuator cylinder for attaching said actuator cylinder to said first portion.

7. The assembly according to claim 1, further comprising a pair of pins, each of said pins extending through said second slot in said second portion of said extension arm, each of said pins extending through said first slot in said first portion of said extension arm such that said second portion is slidably retained on said first portion, each of said pins including knob abutting said upper surface of said second portion, said knob having a diameter being greater than a width of said second slot thereby inhibiting said second portion from being removed from said pins.

8. The assembly according to claim 1, further comprising a lock being movably integrated into an outer wall of said cup on said first portion of said extension arm, said lock being biased into an engaging position such that said lock engages said piston of said jack for retaining said cup at a desired degree of rotation on said piston, said lock being urgeable into a releasing position such that said lock disengages said piston thereby facilitating said cup to be rotated on said piston.

9. The assembly according to claim 1, further comprising a pair of screws, each of said screws being threaded into an outer wall of said collar, each of said screws engaging said slip die when said screws are tightened for retaining said slip die in said collar, each of said screws disengaging said slip die when said screws are loosened thereby facilitating said slip die to be removed from said collar.

10. The assembly according to claim 2, further comprising each of said swing arms has a first end and a second end, each of said swing arms having a pivot point being located adjacent to said first end, said pivot point on each of said swing arms being pivotally attached to a respective one of said wings.

11. The assembly according to claim 10, wherein each of said grips is positioned adjacent to said second end of said respective swing arm, each of said grips comprising a stem extending away from said respective arm and a ball disposed on a distal end of said stem, said plurality of grips including a set of first grips and a set of second grips, each of said first grips being disposed on a top surface of said respective swing arm, each of said second grips being disposed on a bottom surface of said respective swing arm.

12. A blowout prevention installation assembly for remotely installing a safety valve into an oil field drill pipe, said assembly comprising:

a jack being mountable to a drilling platform in an oil field, said jack being actuatable into a lifting condition or a lowering condition, said jack comprising a cylinder and a piston being slidably disposed in said cylinder, said piston being urged upwardly from an upper end of said cylinder when said jack is actuated into said lifting condition, said piston being urged downwardly into said upper end of said cylinder when said jack is actuated into said lowering condition, a base of said cylinder being attachable to the drilling platform such that said cylinder and said piston are vertically oriented on the drilling platform, said base having a plurality of fastener holes for receiving a fastener which engages the drilling platform for retaining said cylinder on the drilling platform;

an extension arm being attached to said jack such that said extension arm is lifted or lowered with respect to the drilling platform when said jack is actuated into a respective lifting condition or lowering condition, said extension arm being oriented to extend laterally away from said jack, said extension arm having a first portion slidably engaging a second portion such that said extension arm has an adjustable length, said first portion having a first slot extending through a top surface and a bottom surface of said first portion, said first slot being elongated to extend along a substantial length of said first portion, said first portion including a cup extending downwardly from said bottom surface, said cup being aligned with a coupled end of said first portion, said cup insertably receiving a top end of said piston of said jack, said second portion having a second slot extending through an upper surface and a lower surface of said second portion, said lower surface resting on said top surface of said first portion such that said second slot is aligned with said first slot, said second portion having a pair of wings each extending laterally away from a respective one of a first lateral edge and a second lateral edge of said second portion, each of said wings being aligned with a free end of said second portion, said extension arm having a collar being integrated into said second portion, said collar being positioned adjacent to said free end of said second portion such that an opening defined by said collar is oriented to extend along an axis being perpendicularly oriented with said extension arm;

an actuator being attached to said first portion of said extension arm, said actuator engaging said second portion of said extension arm, said actuator being actuatable in an extended condition thereby urging said second portion to travel away from said jack thereby facilitating said collar to being positioned over a drill pipe which is integrated into the drilling platform wherein said actuator is configured to align said collar with the drill pipe without requiring a worker to align said collar with the drill pipe thereby inhibiting the worker from being exposed to explosive gasses exiting the drill pipe, said actuator being actuatable in a retracting condition thereby urging said second portion to travel toward said jack, said actuator having an actuator cylinder being attached to said bottom surface of said first portion of said extension arm, said actuator having an actuator piston being slidably integrated into said actuator cylinder, said actuator piston extending outwardly from said actuator cylinder when said actuator is actuated into said extended condition, said actuator piston retracting into said actuator cylinder when said actuator piston is actuated into said retracting condition, said actuator piston having a distal end with respect to said actuator cylinder, said distal end being attached to an engagement being disposed on said lower surface of said second portion of said extension arm, said actuator cylinder having an input port being in fluid communication with an interior of said actuator cylinder, said actuator cylinder having an output being in fluid communication with said interior of said actuator cylinder, said input being fluidly attachable to a send line of a fluid source thereby facilitating a fluid to be pumped into said actuator cylinder thereby urging said actuator piston to extend outwardly from said actuator cylinder said output being fluidly attachable to a return line of the fluid source thereby facilitating the fluid to exit said actuator cylinder thereby urging said actuator piston to retract into said actuator cylinder;

a plurality of brackets, each of said brackets being attached to said first portion of said extension arm, each of said brackets engaging said actuator cylinder of said actuator for attaching said actuator cylinder to said first portion;

a pair of pins, each of said pins extending through said second slot in said second portion of said extension arm, each of said pins extending through said first slot in said first portion of said extension arm such that said second portion is slidably retained on said first portion, each of said pins including knob abutting said upper surface of said second portion, said knob having a diameter being greater than a width of said second slot thereby inhibiting said second portion from being removed from said pins;

a lock being movably integrated into an outer wall of said cup on said first portion of said extension arm, said lock being biased into an engaging position such that said lock engages said piston of said jack for retaining said cup at a desired degree of rotation on said piston, said lock being urgeable into a releasing position such that said lock disengages said piston thereby facilitating said cup to be rotated on said piston;

a slip die being insertable into said collar thereby facilitating said slip die to engage a drill pipe sub joint having a safety valve being attached to the drill pipe sub joint, said collar aligning the safety valve with the drill pipe thereby facilitating the safety valve to be lowered into the drill pipe when said jack is actuated into said lowering condition wherein said collar is configured to insert the safety valve into the drill pipe without requiring the worker to manually insert the safety valve;

a pair of screws, each of said screws being threaded into an outer wall of said collar, each of said screws engaging said slip die when said screws are tightened for retaining said slip die in said collar, each of said screws disengaging said slip die when said screws are loosened thereby facilitating said slip die to be removed from said collar;

a pair of swing arms, each of said swing arms being pivotally attached to said extension arm, each of said swing arms being positionable in a stored position having said swing arms being positioned against said extension arm, each of said swing arms being positionable in a deployed position having said swing arms extending laterally away from said extension arm wherein a respective one of said swing arms is configured to be gripped by the worker for manually pivoting said extension arm into position for lowering the safety valve into the drill pipe, each of said swing arms having a first end and a second end, each of said swing arms having a pivot point being located adjacent to said first end, said pivot point on each of said swing arms being pivotally attached to a respective one of said wings; and a plurality of grips, each of said grips being attached to a respective one of said swing arms thereby facilitating each of said grips to be gripped for manipulating said respective swing arm, each of said grips being positioned adjacent to said second end of said respective swing arm, each of said grips comprising a stem extending away from said respective arm and a ball disposed on a distal end of said stem, said plurality of grips including a set of first grips and a set of second grips, each of said first grips being disposed on a top surface of said respective swing arm, each of said second grips being disposed on a bottom surface of said respective swing arm.

* * * * *